United States Patent [19]

Camp

[11] Patent Number: 4,583,343

[45] Date of Patent: Apr. 22, 1986

[54] TILE SETTING KIT

[76] Inventor: Dariel R. Camp, 2153 Morello Ave., Pleasant Hill, Calif. 94523

[21] Appl. No.: 532,402

[22] Filed: Sep. 15, 1983

[51] Int. Cl.[4] ..... E04D 15/00

[52] U.S. Cl. ..... 52/749; 294/64.1; 52/127.2; 52/127.3

[58] Field of Search ..... 52/749, 127.2, 127.3; 294/64.1; 414/416, 121

[56] References Cited

U.S. PATENT DOCUMENTS

| | | | |
|---|---|---|---|
| 1,549,671 | 8/1925 | Kridler | 52/749 |
| 2,303,393 | 12/1942 | Schmidt | 249/64.1 |
| 2,466,919 | 4/1949 | Sykes | 52/749 |
| 2,534,940 | 12/1950 | Arnold | 52/749 |
| 2,648,974 | 8/1953 | Sommers | 52/749 |
| 2,930,135 | 3/1960 | Rodtz | 52/127.3 |
| 3,061,351 | 10/1962 | Johnson | 294/64.1 |
| 3,231,646 | 1/1966 | Cander | 52/749 |
| 3,240,525 | 3/1966 | Wood | 294/64.1 |
| 3,643,992 | 2/1972 | Jacobucci | 294/64.1 |
| 3,788,026 | 1/1974 | Cook | 52/127.2 |
| 4,091,945 | 5/1978 | Patterson | 294/64.1 |
| 4,277,927 | 7/1981 | Richter | 52/749 |

*Primary Examiner*—Henry E. Raduazo

*Attorney, Agent, or Firm*—Bielen & Peterson

[57] ABSTRACT

A tile setting kit for uniform placement of ceramic-type tiles, particularly for setting tiles on a vertical surface. The tile setting kit includes a starter rack with uniformly displaced spacers for the first course of tiles; an elongated guide frame having replaceable spacer rails with a plurality of uniformly spaced cross teeth arranged in accordance with selected size tile, the frame having further a bubble level for tile course alignment and a support structure with a brace arm and suction attachment that engages the adjacent lower course of set tiles; a spacer unit with suction attachment for support under the adjacent lower course to prevent slippage; and, a tile gun with a releasable suction grip for picking up and placing individual tiles.

21 Claims, 8 Drawing Figures

TILE SETTING KIT

BACKGROUND OF THE INVENTION

This invention relates to an apparatus for aiding the accurate placement or setting of ceramic-type tile. This invention has particular application for setting wall tile and may be advantageously used for setting floor tile.

The use of ceramic-type tile such as porcelain tile, quarry tile or glazed earthenware tiles for floors and walls has become increasingly popular because of their durability, traditional quality, and richness of appearance. Many people have become disenchanted with synthetic materials that imitate nautral earthen tiles, and have installed natural tiles themselves, using the new mastics, grouts and convenient tile cutting equipment provided by tile supplies. It is therefore unfortunate that results are often uneven and unprofessional looking, simply because of irregularities in spacing and alignment. Often such irregularities are not readily apparent during the tile setting procedure and do not readily become discernable until after the tiles have been grouted.

While temporary spacer insets have been devised for insertion between adjacent tiles to obtain uniform spacing, such spacers do not assure continual alignment, and may accumulate spacing or alignment inconsistencies and carry them from course to course. Further, insets do not function well on vertical walls where they may become dislodged.

In order to solve difficulties in placing tiles certain cooperative apparatus was devised to effectively and efficiently set tile. The apparatus is designed for the professional level in tile setting. The professional level tile setter will vastly increase his productivity achieving more accurate placement of tile with substantial savings in time. The apparatus is also particularly suitable for use by the amature tile setter where a professional appearing job is desired. Because the apparatus can be inexpensively manufactured, it is a minor additional expense, which is justified by the substantial saving in the time to complete a project.

The apparatus can be supplied in kit form, sized for a particular tile with replaceable rail elements sized for tiles of different dimension or for variations in the spacing between tiles.

SUMMARY OF THE INVENTION

The tile setting apparatus of this invention comprises a plurality of components useable in whole or in part for setting tile. The apparatus is particularly adapted for setting wall tile, but may be used in part to set floor and ceiling tile. The apparatus is preferably supplied in kit form with a plurality of components that cooperate to facilitate the tile setting procedure and produce a professional result.

The tile setting kit includes a starter rack for a starter row of tile comprising a flat straight edge of thickness equal to the desired spacing between tiles. The straight edge has a series of perpendicularly disposed teeth along one face displaced the width of a tile for positioning tile on the straight edge. The rack is placed, for example, on the floor against a wall for starting a course of tile along the base of the wall. The teeth have a thickness equal to the desired grout space between adjacent tiles.

The primary working component of the kit is a moveable tile fence having a replaceable spacer rail with transverse teeth projecting from both faces of the rail. The tile fence is horizontally oriented with the spacer rail disposed along the top edges of a course of set tile. The downwardly projecting portions of the teeth are inserted in the spaces between adjacent tiles. The orientation of the tile fence is maintained by a support means comprising a pair of brackets with suction pads that engage the faces of two tiles in the set course. The tile fence has a bubble level incorporated in the structure of the fence to indicate the degree of level in the set course and permit corrective adjustment in the fence orientation. In this manner the next course of tiles set along the rail will continue to be true.

Tiles are rapidly set by a tile gun which comprises an important part of the tile kit, but which has other common uses. The tile gun is constructed with a handle and a barrel having a suction pad at the end of the barrel. The tile gun includes a suction release means that breaks the hold of the suction pad with minimum disturbance. Because a tile when gripped by the suction pad and pressed against a tile setting mastic is easily disoriented on the uncured mastic, the preferred release means is a controlled air passage to the underside of a suction cup which is regulated by a trigger operated valve. While a lift ring on the periphery of a suction cup works satisfactorily for most applications, such as the tile fence support, it is not as effective as the air passage means for rapid tile placement on a fresh mastic where a clean release is desired to prevent shift in the tile.

Since the use of the tile fence and tile setting gun substantially reduces the time to set a course of tiles, the mastic often has not cured sufficiently to support the fence and a new course of tiles without migration. To solve this problem, a pair of spacer units are provided which can be installed under the tiles on which the tile fence suction pads are engaged. The spacer units include a support structure with a suction pad to engage the face of a tile on which a spacer element is disposed in the space between the supporting tile and the above tile.

While a suction pad, and in particular a single suction cup is preferred as the engaging element for the tile fence and spacer units because of its particular adaptability for vertical surfaces, other means such as contact adhesive means or wide clamping means may be employed as mechanisms to grip a set tile. It is, of course, understood that for floor or counter top work where tiles are horizontally set, this gripping action is not needed and simple bracing structures may be used.

In order to maximize the utility of the tile setting kit, the preferred support means for orienting the fence is adapted for use of the fence on walls as well as floors. Setting tiles on walls has heretofore been a more challenging job than setting tiles on floors. Using the tile setting kit of this invention, setting tiles on all surfaces is substantially easier with improved results.

DETAILED DESCRIPTION OF THE PREFERRED EMBODIMENT

Figure 1:
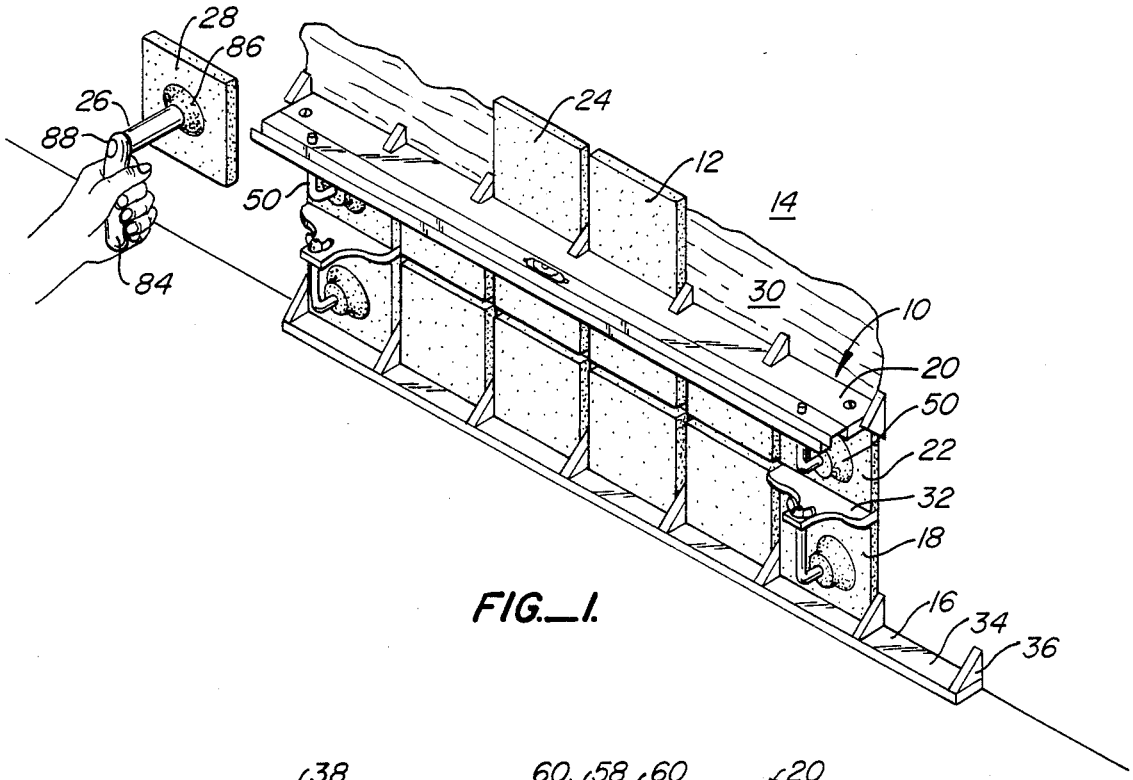
FIG. 1 is a perspective view of the tile setting apparatus in typical use.

Referring to the perspective view of FIG. 1, the tile setting apparatus designated generally by the reference numeral 10 is shown in typical use for setting tile 12 on a wall 14. The tile setting apparatus 10 is preferably supplied in kit form with four primary components. A starter rack 16 is provided for setting the first course 18 of tiles 12. A moveable fence 20 is provided for setting each subsequent course, and is shown above the second course 22 for setting the third course 24 in the typical example of FIG. 1. For placement of individual tiles, a tile gun 26 is provided. The tile gun 26 grips the surface 28 of a tile 12, and permits the tile to be moved into position and set against a mastic 30 on the wall before the tile is released from the gun 26. Spacer units 32 are provided as a fourth component to the tile setting kit. The spacer units 32 are installed on the set tiles under the tile fence 20 to prevent weight of the fence from dislodging or dislocating tiles that have been previously set. These components are described in greater detail with further reference to the other figures of the drawings.

Figure 2:
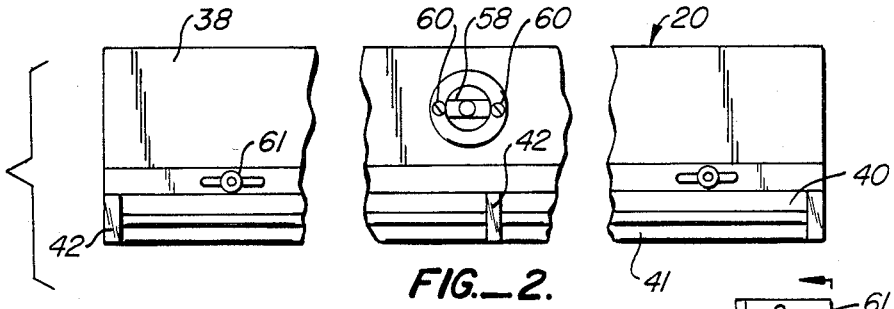
FIG. 2 is a bottom view, partially fragmented, of the tile setting fence.
Figure 3:
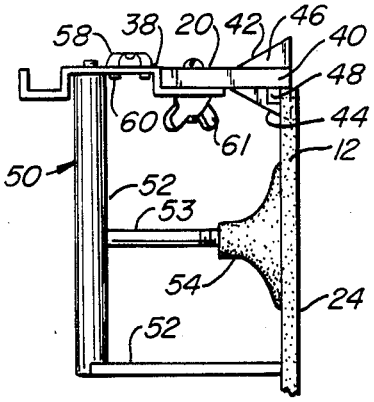
FIG. 3 is an end elevated view of the fence of FIG. 2.
Figure 4:
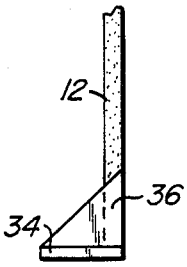
FIG. 4 is an end elevational view of the starter rack.
Figure 5:
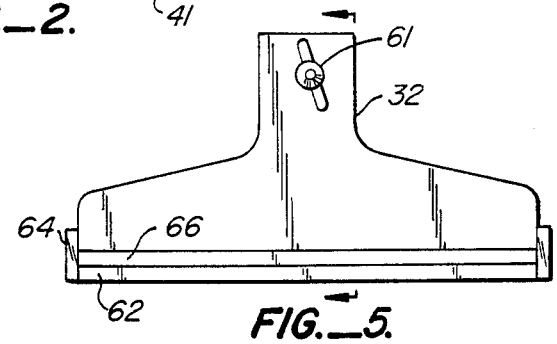
FIG. 5 is a top view of the spacer unit.
Figure 6:
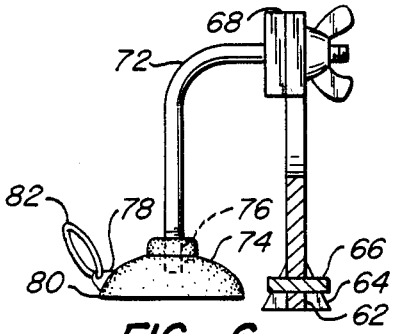
FIG. 6 is a cross-sectional view of the spacer unit taken on the lines 6—6 in FIG. 5.

Referring to FIGS. 1 and 2, the starter rack 16 is simply constructed with an elongated straight edge 34 and a series of perpendicularly disposed, triangular spacer teeth 36. The thickness of the straight edge and width of the teeth conform to the desired grouting space between tiles. The displacement between teeth corresponds to the width of the tiles being set. The inexpensive construction of the starter rack permits a variety of different size racks to be made available to allow the user to select an appropriate rack for the size of tile and grouting space desired. It is contemplated that the kit include several popular sizes, with specialty sizes available from a supplier.

The tile setting fence 20 is constructed with an elongated frame structure 38 to which is attached a removable and replaceable rail 40. The rail 40 is similarly constructed to the rack 16 with an elongated straight edge 41 of thickness corresponding to the desired tile grouting space, and a series of transverse teeth 42 which project from both sides of the straight edge. The teeth 42 have a lower portion 44 engageable in the vertical spaces between the completed course 22 of tiles and have an upper projecting portion 46 which provide the guides and spacers for the course 24 being set. A stop bar 48 between the teeth prevent the straight edge 40 from contacting the mastic, and assists in maintaining the perpendicular disposition of the fence 20 with respect to the set tiles.

The tile setting fence 20 is maintained in position by a support means comprising a pair of brace units 50. Each brace unit has a dowel 52 projecting from the frame structure 38 with a suction mount 53 attached thereto. A suction pad 54 is fastened to the end of the mount 53 which is positioned on the dowel 52 to locate the pad 54 over the flat surface of a tile. A post 56 is connected to the end of the dowel 52 and is directed alongside the suction mount and pad to insure that the fence 20 is maintained perpendicular to the set tiles.

Installed on the center of the frame structure 38 of the fence 20 is a bubble level 58. The bubble level 58 ordinarily indicates that the frame member is level when the bubble is centered. However, the level includes adjustment screws 60 for altering the orientation of the level with respect to the frame structure 38 where the work performed is along a rise, as is common in tunnel work.

The rail 40 is fastened to the frame structure 38 by screws 61 to permit the rail 40 to be removed and replaced by other similarly constructed rails of different dimension to accomodate tiles of different size.

The spacer units 32 are provided to insure support of the tile setting fence 20. Since tiles are rapidly placed using the described apparatus, the mastic 30 may not have set sufficiently to hold a tile with the added weight of the fence 20 in beginning a new course, and prevent downward drift of the tile and fence by plastic flow of the mastic. A spacer unit 32 is therefore inserted in the grout space under the tile to which the suction pad is adhered. The spacer unit has a spacer rail 62 the width of a tile which is inserted in the horizontal grout space, and two end teeth 64 which are inserted in a portion of the vertical juncture spaces at the sides of the tile. A stop bar 66 prevents the spacer rail and end teeth from penetrating too deeply in the grout spaces to become fouled with the mastic. The stop bar, spacer rail and end teeth are connected to a bracket 68. The bracket 68 has a support brace 70 to which is mounted a strut 72 connected to a suction pad 74. The suction pad 74 has an internal metal inset 76 which threadably engages the threaded end of the strut 72. The suction pad 74 has a tab 78 located on the periphery of the circular cup 80 with a pull ring 82 for releasing the suction when the pad is engaged on a tile by lifting the edge of the cup.

The tile gun 26 is constructed to place tiles quickly and accurately. The design of the tile gun allows tiles to be placed with one hand without directly handling the tile on its edges with the resultant incidental finger contact in the mastic as occasionally is encountered using conventional procedures.

The tile gun is basically constructed with a hand grip structure 84, a suction pad 86 and an air relief mechanism 88. While a pull ring and tab relief similar to that on the spacer unit may be adapted for the tile gun, it is preferred that a more sophisticated relief be used to insure a tile being set is accurately placed and released without disturbance. The particular components selected for the basic unit may be varied as illustrated by the exemplar alternate embodiments of FIGS. 7 and 8.

The tile guns shown in the alternate embodiments are mechanical in structure. It is to be understood that equivalent pneumatic, hydralic or electrical components may be substituted for the mechanical structure shown in the figures for triggering the release.

Figure 7:
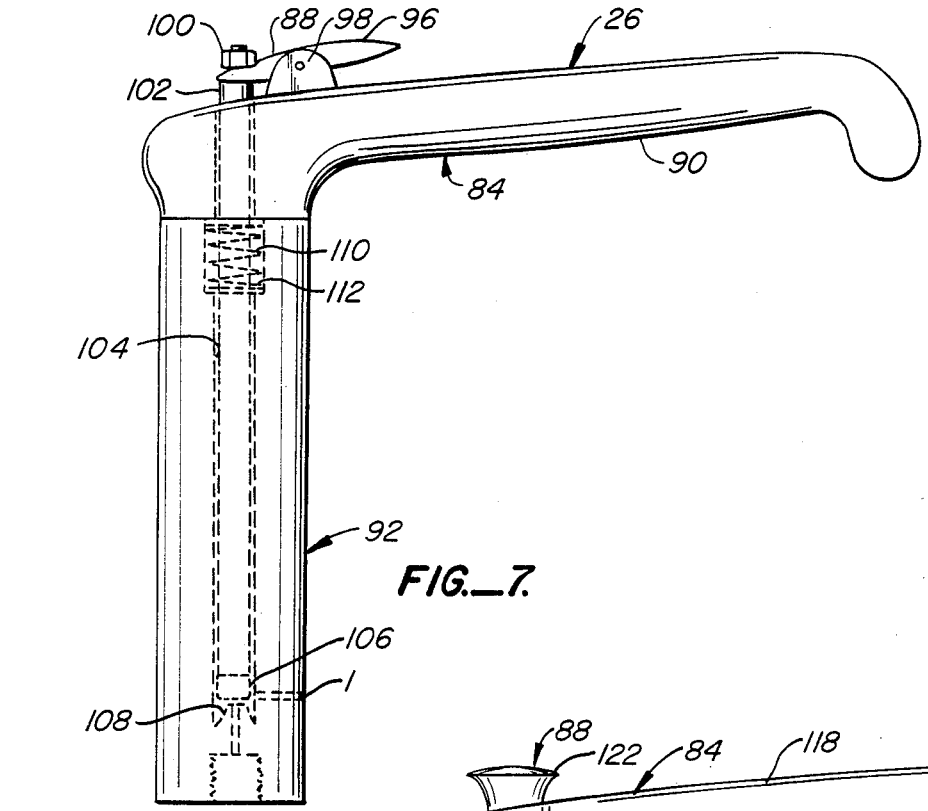
FIG. 7 is a cross-sectional view of a first embodiment of the tile gun.

Referring to FIG. 7, the hand grip structure 84 comprises a handle 90 that is connected at one end to an elongated pad post 92. The suction pad 86 has an inset 94 that is threaded to the other end of the pad post 92. The air relief mechanism 88 includes a thumb trigger 96 in a pivot mount 98 on the handle 90. The thumb trigger is linked by a stud and nut assembly 100 to a lift rod 102, that is retained in a bore 104 concentrically located in the pad post. At the end of the lift rod 102 is a flaired seal 106 which engages a seat 108 at the end of the bore 104. The lift rod 102 is biased by a spring 110, that engages a collar 112 on the lift rod and directs the seal 106 against the seat 108 to close an air relief passage 114. The air relief passage passes through the wall of the post to the bore and down through the seat 108, inset 94 and pad 86 allowing the suction of underside 116 of the pad 86 an air relief when the lift rod 102 is displaced, lifting the seal from the seat, on depression of the thumb trigger.

Figure 8:
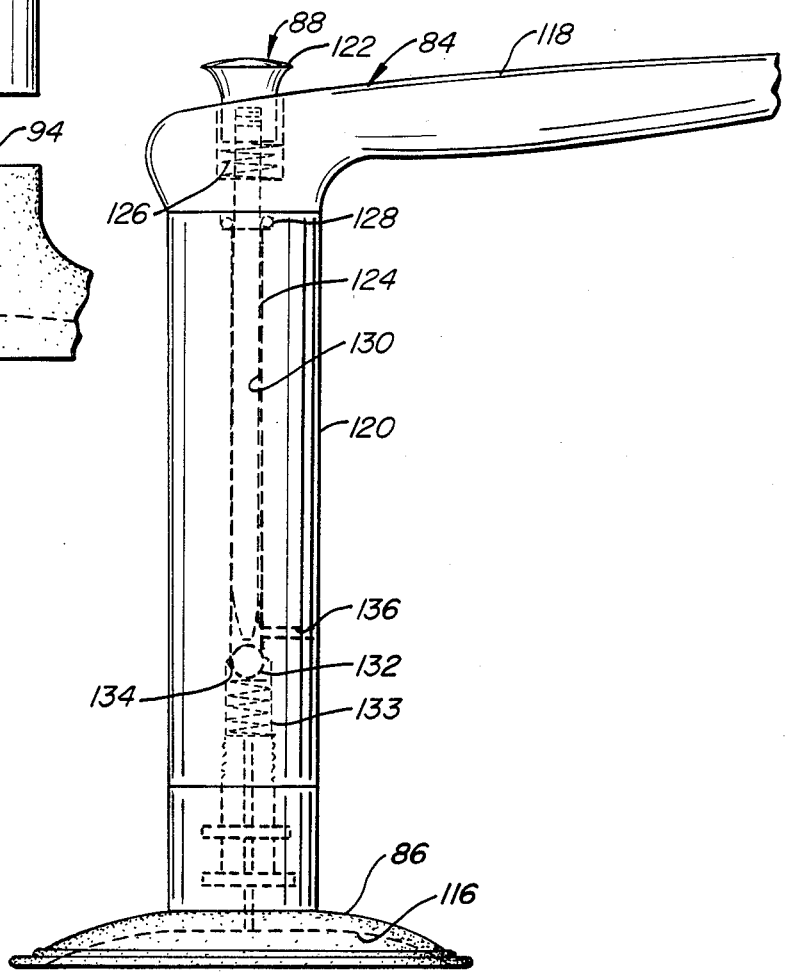
FIG. 8 is a cross-sectional view of a second embodiment of the tile gun.

Referring to the alternate embodiment of FIG. 8, the hand grip structure 84 comprises a similar handle 118 that is connected to a pad post 120 with a suction pad 86 connected thereto. The air relief mechanism 88 includes a thumb operated striker button 122 on the handle. The striker button 122 is threaded to a rod 124 and biased by a spring 126. The rod 124 extends through an O-ring seal 128 into a bore 130 in the pad post 120 to contact a ball 132. The ball 132 is biased by a spring 133 against a seat 134 in the bore 130 to seal an air passage 136 from outside of the pad post to the underside 116 of the pad 86 in the same manner as the previously described embodiment. Upon depressing the button 122, the ball 132 is displaced from the seat and an air relief is provided to the underside of the suction pad 86.

The air relief mechanism therefore comprises an air relief passage to the underside of the suction pad and a valve device in the air relief passage that is operated by a trigger to open the passage.

In this manner, the suction grip holding a tile to the tile gun is released, permitting accurate placement of a tile. It can be appreciated that the tile gun is useful for picking up and moving a variety of objects, for example, cans in a packed box, hot plates, glass, or other items of relatively smooth and flat surface.

While in the foregoing embodiments of the present invention have been set forth in considerable detail for the purposes of making a complete disclosure of the invention, it may be apparent to those of skill in the art that numerous changes may be made in such detail without deparating from the spirit and principles of the invention.

What is claimed is:

1. Apparatus for setting tile comprising:

a tile fence having an elongated frame structure with a straight edge of width corresponding to a desired grout space, and a plurality of teeth spaced along said straight edge the length of tiles to be set, said teeth being perpendicularly disposed to said straight edge and of width corresponding to a desired grout space; and, support means for supporting said frame structure with respect to set tiles wherein said straight edge and teeth are disposed at the grout space to provide a guide for additional tiles to be set adjacent the set tiles; wherein said means for supporting said frame structure comprises a brace structure connected to said frame structure with contact means comprising a suction pad for contacting and engaging set tile.

2. The apparatus of claim 1 wherein said straight edge and teeth are fixedly interconnected and said straight edge with teeth is removably joined to said frame structure for replacement with other similarly constructed straight edges of different size and different spacing of teeth.

3. The apparatus of claim 1 wherein said straight edge includes stop means for limiting the penetration of said straight edge and teeth in the grout space.

4. The apparatus of claim 1 wherein said tile fence includes a level indicator means for defining the orientation of the tile fence.

5. The apparatus of claim 1 wherein said contact means includes a contact post which cooperates with said suction pad to orient said fence perpendicular to the surface of set tiles.

6. The apparatus of claim 1 comprising further, a starter rack for setting a first course of tile, said starter rack having a straight edge with a plurality of teeth projecting from one side of the straight edge, said straight edge being adapted for placement against a floor or wall for starting a course of tiles against said straight edge between said teeth.

7. The apparatus of claim 1 comprising further a tile gun, wherein said tile gun has a hand grip structure and means for releasably engaging tile for pickup, transport and placement of a tile.

8. The apparatus of claim 7 wherein said means for releasably engaging tile comprises a suction pad with air relief means for admitting air to the underside of said suction pad.

9. The apparatus of claim 8 wherein said air relief means comprises an air passage to the underside of said suction pad and trigger operated valve means in said air passage.

10. The apparatus of claim 9 wherein said valve means comprises a ball valve having a ball, a ball seat, a spring biasing said ball against said seat, a rod contacting said ball for displacing said ball from said seat, and a trigger engaging said rod for actuating said ball valve by displacing said rod.

11. The apparatus of claim 9 wherein said valve means comprises a stop valve having a rod with an end seal, a seat against which said end seal is engagable, a spring engaging said rod and biasing said seal against said seat, and a trigger engaging said rod for actuating said stop valve by displacing said rod.

12. Apparatus for setting tile comprising:

a tile fence having an elongated frame structure with a straight edge of width corresponding to a desired grout space, and a plurality of teeth spaced along said straight edge the length of tiles to be set, said teeth being perpendicularly disposed to said straight edge and of width corresponding to a desired grout space; a support means for supporting said frame structure with respect to set tiles wherein said straight edge and teeth are disposed at the grout space to provide a guide for additional tiles to be set adjacent the set tiles; and spacer units each having a rail with a width corresponding to the grout space, said spacer units being adapted for cooperation with said support means on said tile fence by maintaining the grout space of set tiles on insertion of said rail in the grout space below said tile fence support means.

13. The apparatus of claim 12 wherein said spacer units include mounting means for maintaining said rail in a grout space.

14. The apparatus of claim 13 wherein said mounting means comprises a bracket structure having a suction pad engageable with the surface of a set tile.

15. The apparatus of claim 14 wherein said rail of said spacer unit includes end teeth mounted perpendicular to said rail for insertion in grout spaces.

16. The apparatus of claim 15 wherein said rail includes a stop structure for limiting the penetration of said rail and teeth in the grout spaces.

17. An improved device for pickup, transport and release of substantially flat, smooth surface objects such as tile and the like, comprising a suction gun having a hand grip structure in the form of a stylized, pistol grip handle, and, a barrel joined to one end of the handle and arranged substantially perpendicular thereto, the barrel having a terminal end with a circular suction pad attached and centered thereon, wherein the suction pad and barrel have a central air relief means for admitting air to the underside of said suction pad when suction engaged with a flat, smooth surface, the air relief means including an air passage in the barrel to the underside of the suction pad, a valve in the air passage biased to closure on suction engagement of the suction pad, and a triggering means for opening the valve, said triggering means having a valve actuating member with a connected thumb adapted to open the valve and release the suction engagement of the suction pad on depression of said thumb member in a direction toward the suction pad, said thumb member being arranged substantially at the juncture of said barrel and handle for convenient thumb operation.

18. The deivce of claim 17 wherein said valve comprises a ball valve having a ball, a ball seat, a spring biasing said ball against said seat, a rod contacting said ball for displacing said ball from said seat, and a trigger engaging said rod for actuating said ball valve by displacing said rod, said trigger comprising an end button, at the end of said rod and a bias spring engaging said button said end button comprising said thumb member, wherein said rod is depressed and said ball is unseated on depressing said thumb member against the bias of said bias spring.

19. The device of claim 17 wherein said valve comprises a stop valve having a rod with an end seal, a seat against which said end seal is engagable, a spring engaging said rod and biasing said seal against said seat, and a trigger engaging said rod for actuating said stop valve by displacing said rod, said trigger comprising a lever with an actuating end contacting said rod and an opposite end comprising said thumb member engageable by a user's thumb wherein said rod is lifted and said end seal is unseated on depressing said thumb member.

20. The device of claim 17 wherein said valve comprises a sealing member, a seating member, and spring bias means for biasing said sealing element against said seating member, wherein said actuating member displaces said sealing member away from said seating member on depression of said thumb member.

21. The device of claim 20 wherein said suction pad is threaded to said terminal end of said barrel and is removable therefrom for replacement.

* * * * *